US010850943B2

(12) United States Patent
Hawkins et al.

(10) Patent No.: US 10,850,943 B2
(45) Date of Patent: Dec. 1, 2020

(54) ROLLER GUIDE ASSEMBLY AND ELEVATOR SYSTEM

(71) Applicant: Kone Corporation, Helsinki (FI)

(72) Inventors: Giovanni Hawkins, Helsinki (FI); Timo Lamminmaki, Helsinki (FI); Tapio Siironen, Helsinki (FI); Jani Uskali, Helsinki (FI); Sami Janhunen, Helsinki (FI)

(73) Assignee: Kone Corporation, Helsinki (FI)

( * ) Notice: Subject to any disclaimer, the term of this patent is extended or adjusted under 35 U.S.C. 154(b) by 379 days.

(21) Appl. No.: 15/692,297

(22) Filed: Aug. 31, 2017

(65) Prior Publication Data

US 2018/0093863 A1 Apr. 5, 2018

(30) Foreign Application Priority Data

Sep. 30, 2016 (EP) ..... 16191769

(51) Int. Cl.
*B66B 7/04* (2006.01)
*B66B 7/02* (2006.01)

(52) U.S. Cl.
CPC ..... *B66B 7/046* (2013.01); *B66B 7/023* (2013.01); *B66B 7/048* (2013.01)

(58) Field of Classification Search
CPC ..... B66B 7/023; B66B 7/048; B66B 7/046
See application file for complete search history.

(56) References Cited

U.S. PATENT DOCUMENTS 2,498,299 A 2/1950 Rissler
3,329,240 A * 7/1967 Harwood ..... B66B 7/046 187/410

(Continued)

FOREIGN PATENT DOCUMENTS

CN 104411615 A 3/2015
WO WO-2012/172400 A2 12/2012
WO WO-2014/009253 A1 1/2014

OTHER PUBLICATIONS

European Search report for European Patent Application No. 16191769.5 dated Apr. 25, 2017.

(Continued)

*Primary Examiner* — Diem M Tran

(74) *Attorney, Agent, or Firm* — Harness, Dickey and Pierce, P.L.C.

(57) ABSTRACT

A roller guide assembly for an elevator device, the roller guide assembly comprising a base member having a mounting means for mounting to the elevator device, the base member comprising a shaft support member; a roller wheel for engaging a guide rail to be rolled on the guide rail; a shaft on which the roller wheel is bearing-mounted, the shaft being straight and non-rotatably supported by the shaft support member, and a vibration dampening element, the vibration dampening element comprising an elastomer body arranged between the shaft and the shaft support member for dampening vibration of the roller wheel and for isolating the vibration from the base member. The shaft is attached to the shaft support member by the vibration dampening element forming a single attachment point for the shaft. The elastomer body is configured to form an elastically spring-loaded universal joint for the attachment of the shaft to provide a universal degree of freedom of an angular movement of the shaft and the roller wheel in relation to the base member.

19 Claims, 5 Drawing Sheets

(56) References Cited

U.S. PATENT DOCUMENTS

| | | | | |
|---|---|---|---|---|
| 3,856,117 | A * | 12/1974 | Solymos | B66B 7/046 187/406 |
| 9,434,579 | B2 * | 9/2016 | Arai | B66B 7/046 |
| 9,650,228 | B2 * | 5/2017 | Sakuma | B66B 7/046 |

OTHER PUBLICATIONS

Office Action for corresponding Chinese Application No. 201710813203.6 dated Apr. 14, 2020.

* cited by examiner

ROLLER GUIDE ASSEMBLY AND ELEVATOR SYSTEM

This application claims priority to European Patent Application No. EP161917695 filed on Sep. 30, 2016, the entire contents of which are incorporated herein by reference.

FIELD OF THE INVENTION

The present invention relates to a roller guide assembly or an elevator device arranged to guide an elevator car and/or counterweight along a guide rail. Further, the invention relates to an elevator system.

BACKGROUND OF THE INVENTION

Generally, the elevator (car, sling and counterweight) moves vertically up and down in an elevator shaft, guided either by roller guides or sliding guide shoes. Roller guides are used for higher speeds, and reduced friction. Usually at higher speeds the roller wheels are isolated from the roller body by springs located between swinging roller wheel arms and the roller body. This isolates lower frequency vibration from the imperfections and irregularities of the guide rails in a horizontal direction, and the elastomeric tyres of the roller wheels isolate some noise from the guide rail contact into the roller housing.

U.S. Pat. No. 2,489,299 discloses a roller guide assembly comprising a base member having a mounting means for mounting to the elevator device. The base member comprises a shaft support member. The roller guide assembly comprises a roller wheel for engaging a guide rail to be rolled on the guide rail and a shaft on which the roller wheel is bearing-mounted. The shaft is straight and non-rotatably supported by the shaft support member. Further, the roller guide assembly comprises a vibration dampening element. The vibration dampening element comprises an elastomer body arranged between the shaft and the shaft support member for dampening vibration of the roller wheel and for isolating the vibration from the base member when the roller wheels move along the guide rail across and over the irregularities and stepped portions of the connections portion of the guide rail.

OBJECTIVE OF THE INVENTION

The objective of the invention is to provide an improved roller guide assembly which has a simple and low-cost structure having a small number of parts. Further, an objective of the invention is to provide a roller guide assembly which can be assembled easily and rapidly. Further, an objective of the invention is to provide a roller guide assembly that provides an improved noise and vibration isolation from roller wheel to the base member and via the base member to an elevator device to which the base member is attached, such as a car or a counterweight of the elevator system.

SUMMARY OF THE INVENTION

According to a first aspect, the present invention provides a roller guide assembly for an elevator device. The roller guide assembly comprises a base member having a mounting means for mounting to the elevator device, the base member comprising a shaft support member. The roller guide assembly comprises a roller wheel for engaging a guide rail to be rolled on the guide rail. The roller guide assembly comprises a shaft on which the roller wheel is bearing-mounted, the shaft being straight and non-rotatably supported by the shaft support member. The roller guide assembly comprises a vibration dampening element, the vibration dampening element comprising an elastomer body arranged between the shaft and the shaft support member for dampening vibration of the roller wheel and for isolating the vibration from the base member. According to the invention the shaft is attached to the shaft support member by the vibration dampening element forming a single attachment point for the shaft, the elastomer body of the vibration dampening element being configured to form an elastically spring-loaded universal joint for the attachment of the shaft to provide a universal degree of freedom of an angular movement of the shaft and the roller wheel in relation to the base member.

The advantage of the invention is that the elastomer body providing a single attachment point and an elastically spring-loaded universal joint for the shaft allows an angular movement for the shaft and the roller wheel, thus enabling that the vibration (caused by irregularities of the guide rail and stepped portions of the connections portion of the guide rail) will not be transmitted to the base member, although the irregularities may cause a wide range of movement of the roller wheel and the angular movement may then have a correspondingly large turning angle. Furthermore, the elastomeric body provides higher frequency noise isolation from the roller wheel/guide rail to the car.

In one embodiment of the roller guide assembly the base member and the shaft support member are formed of a single uniform metal plate, the shaft support member being bent at a straight angle from the plane of said metal plate.

In one embodiment of the roller guide assembly the shaft support member comprises a mounting hole for receiving the vibration damping element therein.

In one embodiment of the roller guide assembly the elastomer body is annular or polygonal, such as square, rectangular, pentagonal or hexagonal in shape.

In one embodiment of the roller guide assembly the vibration dampening element comprises a metal tube having a first central through hole through which the shaft extends, the metal tube having an outer surface. The elastomer body is concentrically or eccentrically around the metal tube and fixedly attached to the outer surface. If the geometric center of the elastomer body and the geometric center of the metal tube do not coincide, but are offset in relation to each other, then the position of the metal tube, and thereby the position of the roller wheel in relation to the guide rail, can be changed by rotating the vibration dampening element in relation to the shaft support member. This enables that the same vibration dampening element can be used for different guide rail sizes and dimensions. A stepped adjustment can be achieved by choosing the shape of the elastomer body to be polygonal, i.e. square, rectangular, pentagonal or hexagonal.

In one embodiment of the roller guide assembly the outer surface of the metal tube is cylindrical.

In one embodiment of the roller guide assembly the outer surface of the metal tube comprises a conical portion.

In one embodiment of the roller guide assembly the elastomer body comprises an annular groove disposed at an outer periphery of the elastomer body. The annular groove has a width and depth adapted to receive an edge portion of the mounting hole for mounting the elastomer body to the shaft support member.

In one embodiment of the roller guide assembly the vibration dampening element is divided into two vibration dampening element halves which are mounted to the mounting hole from opposite sides of the shaft support member.

In one embodiment of the roller guide assembly each of the vibration dampening element halves comprises a shoulder having a diameter substantially corresponding to the diameter of the mounting hole. The shoulders of the vibration dampening element halves together form an annular groove to receive an edge of the mounting hole for mounting the vibration dampening element to the shaft support member.

In one embodiment of the roller guide assembly the vibration dampening element comprises a pair of end caps for covering both sides of the elastomer body. Each end cap comprises a second central through hole through which the shaft extends, the second through hole having a smaller diameter than an outer diameter of the metal tube, so that the end caps abut against the ends of the metal tube at both sides of the elastomer body.

In one embodiment of the roller guide assembly the end cap is cup-like and comprises an annular flange which extends over a part of the outer periphery of the elastomer body.

In one embodiment of the roller guide assembly the vibration dampening element comprises a mounting flange made of metal. The mounting flange is fixedly attached to the elastomer body. The mounting flange has bolt holes for attaching the vibration dampening element to the shaft support member with bolted joints.

In one embodiment of the roller guide assembly the roller guide assembly comprises two or more roller wheels.

According to a second aspect, the present invention provides an elevator system, wherein the elevator system comprises a roller guide assembly according to the first aspect.

It is to be understood that the aspects and embodiments of the invention described above may be used in any combination with each other. Several of the aspects and embodiments may be combined together to form a further embodiment of the invention.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Figure 1:
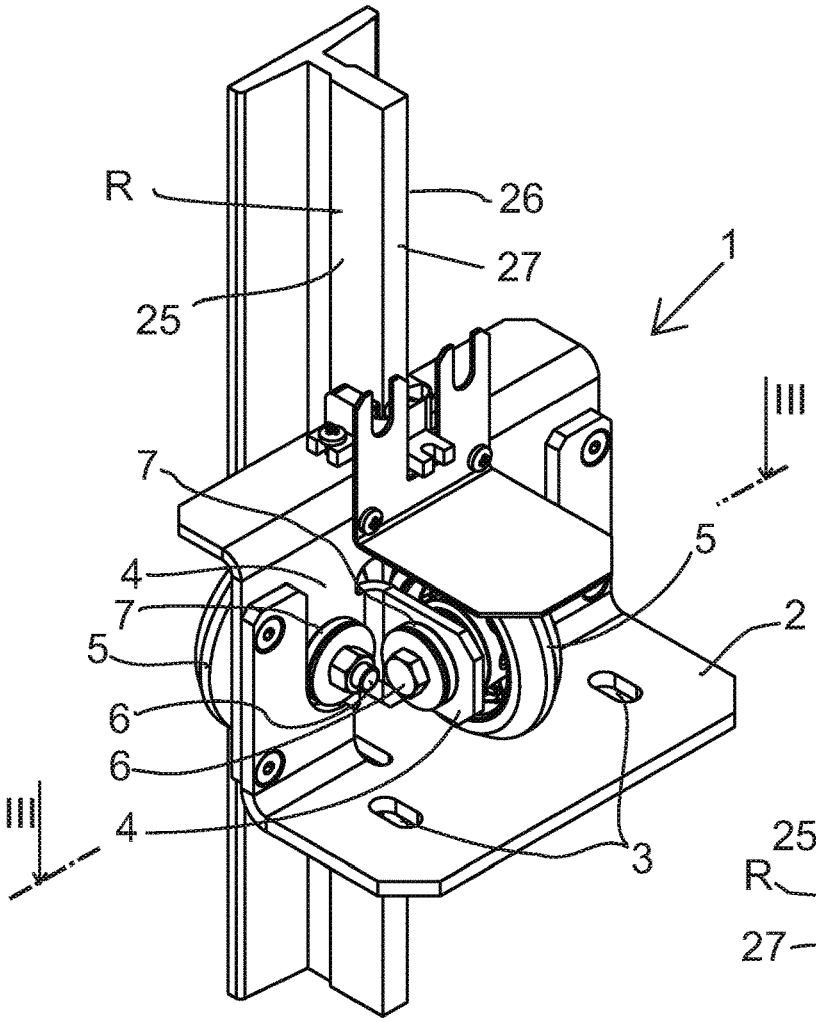
FIG. 1 shows an axonometric view of a roller guide assembly according to a first embodiment of the invention seen obliquely from above.
Figure 2:
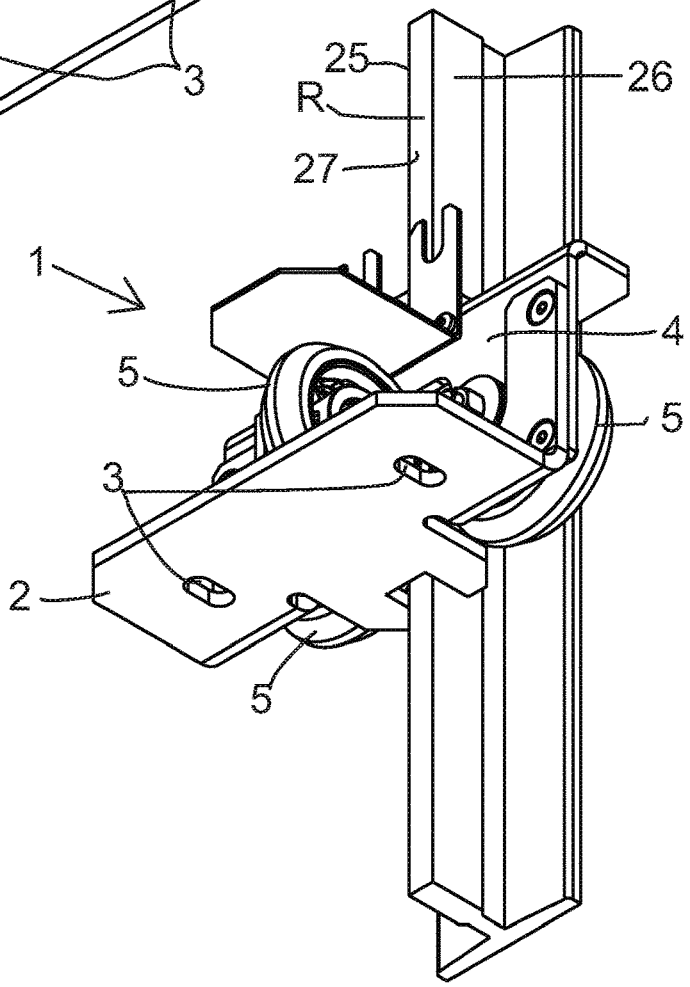
FIG. 2 shows an axonometric view of a roller guide assembly of FIG. 1 seen obliquely from below.

FIGS. 1 and 2 show a roller guide assembly 1 for an elevator device (not shown). In FIGS. 1 and 2 the roller guide assembly 1 is shown to be engaged with the guide rail R and rolling along the guide rail. The shown embodiment comprises three roller wheels 5 orthogonally engaged with the guide rail R, so that two roller wheels 5 engage with parallel guide surfaces 25, 26 of the guide rail on its both opposite sides. These two roller wheels 5 have their planes of rotation in a common vertical plane. One roller wheel 5 engages with the frontal guide surface 27 of the guide rail. Although, the exemplary embodiments show roller guide assemblies having three roller wheels 5, it should be noted that the roller guide assembly according to the invention may include any number of roller wheels supported to the base member according to the principles of the invention.

Figure 3:
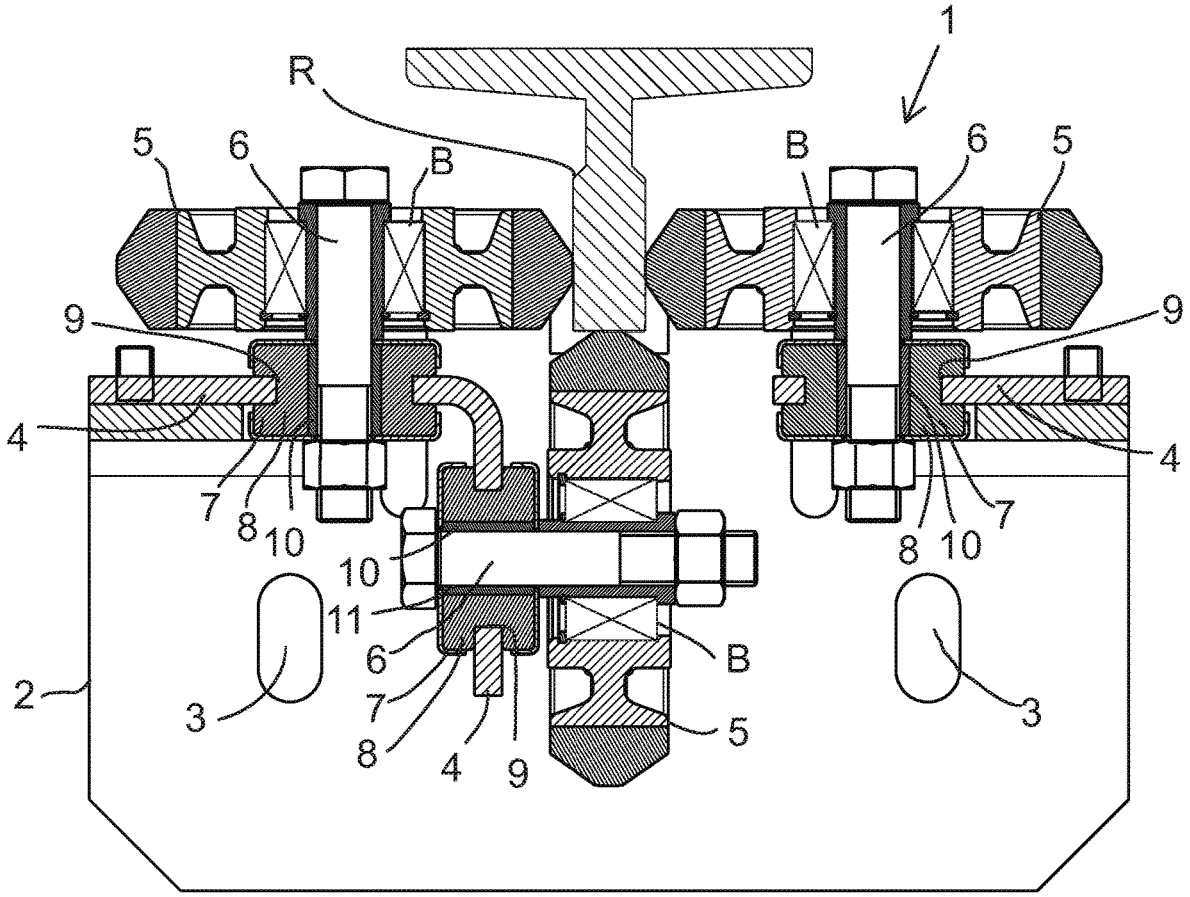
FIG. 3 shows a cross-section III-III from FIG. 1.
Figure 10:
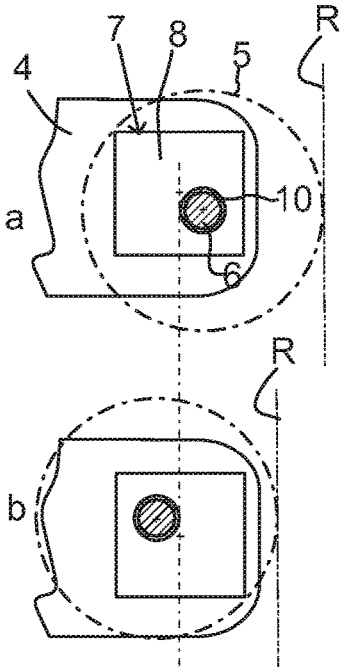
Figure 11:
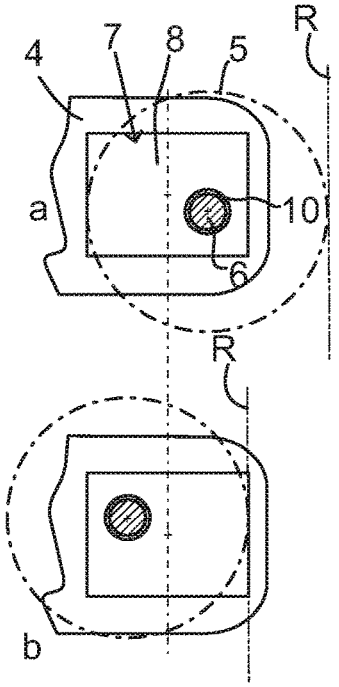

Referring to FIGS. 1 to 3, the roller guide assembly 1 comprises a base member 2. The base member 2 comprises mounting means 3, such has holes for bolted joints, for mounting the base member 2 to an elevator device, such as to a car, sling and/or counterweight, as illustrated in FIGS. 10 and 11. The base member 2 comprises a shaft support member 4. The roller guide assembly 1 further comprises a roller wheel 5 for engaging a guide rail R. The roller wheel 5 is bearing-mounted on a shaft 6. The bearing B is built into the hub of the roller wheel. The shaft 6 is straight and non-rotatably supported by the shaft support member 4 via a vibration dampening element 7. The vibration dampening element 7 comprises an elastomer body 8 arranged between the shaft 6 and the shaft support member 4 for dampening vibration of the roller wheel and for isolating the vibration from the base member.

The shaft 6 is attached to the shaft support member 4 by the vibration dampening element 7. The vibration dampening element 7 forms a single attachment point for the shaft 6. The elastomer body 8 of the vibration dampening element 7 is configured to form an elastically spring-loaded universal joint for the attachment of the shaft 6 to provide a universal degree of freedom of an angular movement of the shaft and the roller wheel 5 in relation to the base member 2.

The base member 2 and the shaft support member 4 may be formed of a single uniform metal plate. The shaft support member 4 may be bent at a straight angle from the plane of said metal plate.

Referring to FIG. 3, the shaft support member 4 comprises a mounting hole 9 for receiving the vibration damping element 7 therein.

The elastomer body 8 has an annular shape. The vibration dampening element 7 comprises a metal tube 10 having a first central through hole 11 through which the shaft 6 extends. The metal tube 10 has a cylindrical outer surface 12. The annular elastomer body 8 is concentrically around the metal tube 10 and may be attached to the outer surface 12 of the metal tube 1.

Figure 4:
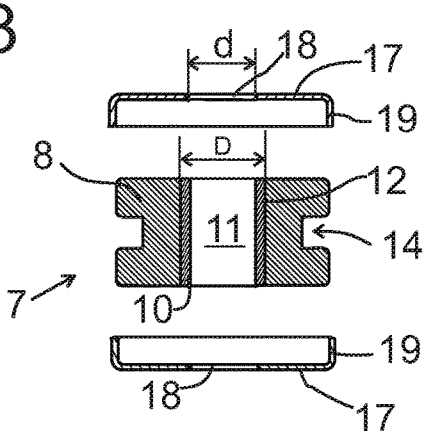
FIG. 4 shows a cross-section of a vibration dampening element of the embodiment of the roller guide assembly of FIG. 3.

As can be seen in FIGS. 3 and 4, the elastomer body 8 comprises an annular groove 14 disposed at an outer periphery 15 of the elastomer body 8. The annular groove 14 has a width and depth adapted to receive an edge portion of the mounting hole 9 for mounting the elastomer body 8 to the shaft support member 4.

As shown in FIGS. 3 and 4, the vibration dampening element 7 comprises a pair of end caps 17 for covering both sides of the elastomer body 8. The end cap 17 comprises a second central through-hole 18 through which the shaft 6 extends. The second central through hole 18 has a smaller diameter d than an outer diameter D of the metal tube 10, so that the end caps 17 abut against the ends of the metal tube 10 at both sides of the elastomer body 8. The end cap 17 is cup-like and comprises an annular flange 19 which extends over a part of the outer periphery 14 of the elastomer body 8. The end caps 17 limit the excessive movement of the roller wheels and they also improve safety in case of failure of the elastomer body 8 by preventing the roller wheels from hitting fixing elements of the guide rail.

In the shown embodiments the shaft 6 is a bolt having a bolt head at one end and an outer thread at the other end onto which a lock nut can be threaded to fix the roller wheel 5 to the vibration dampening element 7. Tightening force of the bolt does not compress the elastomer body 8.

Figure 5:
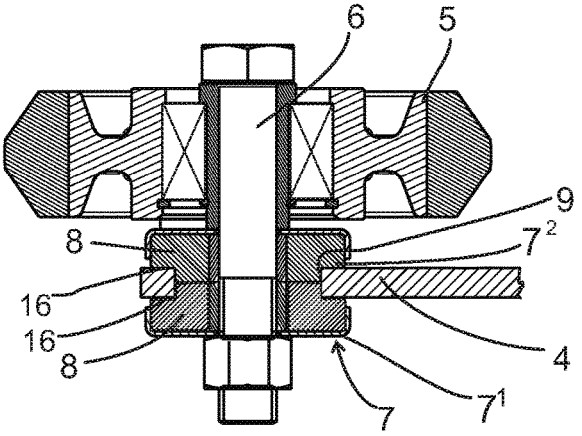
FIG. 5 shows a cross-section of part of a roller guide assembly according a second embodiment of the invention.
Figure 6:
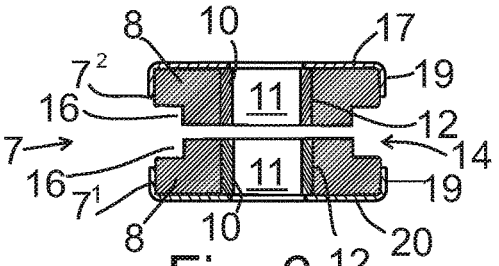
FIG. 6 shows a cross-section of a vibration dampening element of the embodiment of the roller guide assembly of FIG. 5.

In another exemplary embodiment shown in FIGS. 5 and 6 the vibration dampening element 7 is divided into two vibration dampening element halves $7^1$, $7^2$ which can be mounted to the mounting hole 9 from opposite sides of the shaft support member 4.

Referring to FIG. 6, each of the two vibration dampening element halves $7^1$, $7^2$ comprises an elastomer body 8, a metal tube 10 and an end cap 17. Further, each of the two vibration dampening element halves $7^1$, $7^2$ comprises a shoulder 16 having a diameter that snugly fits to the diameter of the mounting hole 9. The shoulders 16 of the vibration dampening element halves $7^1$, $7^2$ together form an annular groove 14, likewise as in the one-piece elastomer body 8 of FIG. 4, to receive an edge portion of the mounting hole 9 for mounting the vibration dampening element 7 to the shaft support member 4.

Figure 7:
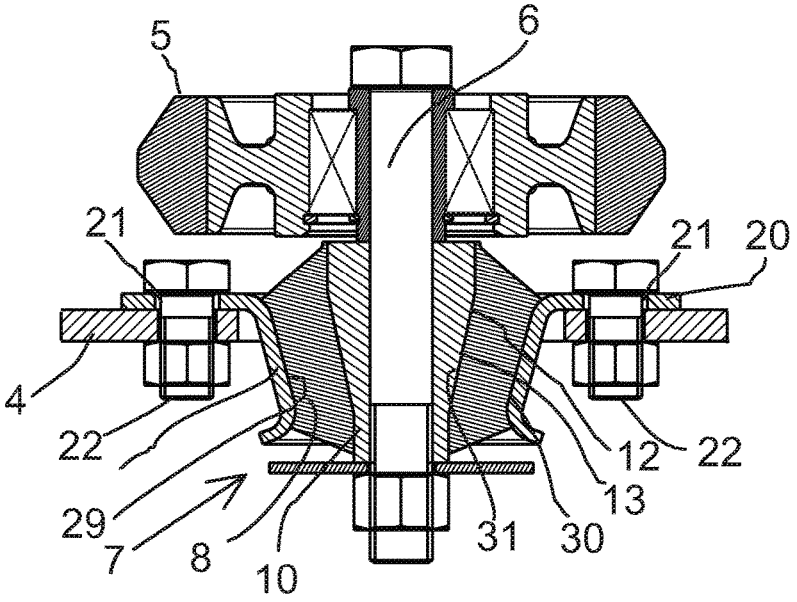
FIG. 7 shows a cross-section of part of a roller guide assembly according a third embodiment of the invention.
Figure 8:
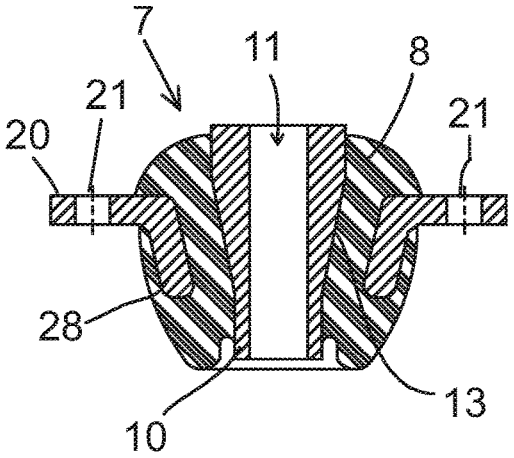
FIGS. 8 and 9 show cross-sections of two further embodiments of the vibration dampening element which can be used in the roller guide assembly according to the invention, FIG. 10 schematically shows a further embodiment of the vibration dampening element wherein the metal tube is eccentric in relation to a square-shaped elastomer body, the vibration dampening element being mounted in different positions a and b to the shaft support member, FIG. 11 schematically shows a further embodiment of the vibration dampening element wherein the metal tube is eccentric in relation to a rectangular elastomer body, the vibration dampening element being mounted in different positions a and b to the shaft support member, FIG. 12 schematically shows a further embodiment of the vibration dampening element wherein the metal tube is eccentric in relation to a pentagonal elastomer body, the vibration dampening element being mounted in different positions a, b, c, d and e to the shaft support member, FIG. 13 schematically shows a further embodiment of the vibration dampening element wherein the metal tube is eccentric in relation to a hexagonal elastomer body, the vibration dampening element being mounted in different positions a, b, c, and d to the shaft support member.
Figure 9:
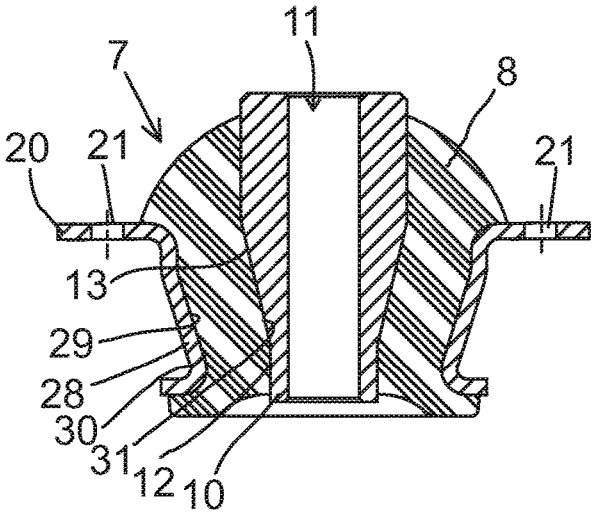

In a further exemplary embodiment shown in FIGS. 7 to 9, for the mounting of the roller wheel 5 to the shaft support member 4 the vibration dampening element comprises a mounting flange 20 made of metal. The mounting flange 20 is fixedly attached to the elastomer body 8. FIGS. 7 and 9 show examples of the vibration dampening element 7 in which the mounting flange 20 comprises a collar 28 having an inner surface 29 which is fixedly attached to the outer surface 30 of the elastomer body 8. The inner surface 31 of the elastomer body 8 is fixedly attached to outer surface 12 of the metal tube 10. The outer surface 12 of the metal tube 10 has a conical portion 13. The mounting flange 20 has bolt holes 21 for attaching the vibration dampening element 7 to the shaft support member 4 with bolted joints 22.

FIG. 8 also shows an embodiment of the vibration dampening element 7 comprising a mounting flange 20 made of metal. This embodiments differs from the embodiments of FIGS. 7 and 9 in that the mounting flange 20 is fixedly attached to the elastomer body 8 so that the collar 28 of the mounting flange is embedded into the material of the elastomer body 8.

In all shown embodiments the elastomer body 8 may be made of rubber, natural rubber, styrene-butadiene rubber, chloroprene, nitrile rubber, silicone rubber, polyurethane or any combination thereof.

Figure 12:
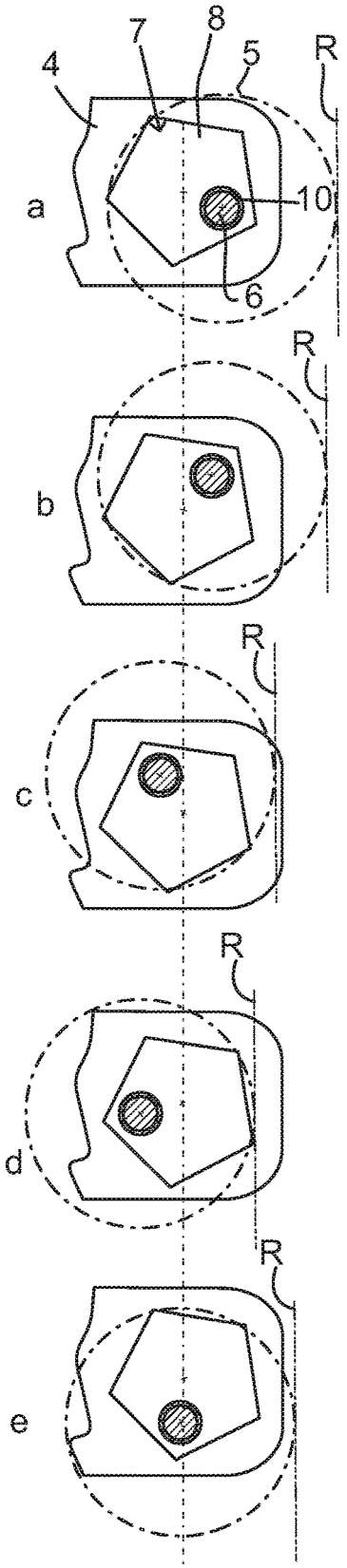
Figure 13:
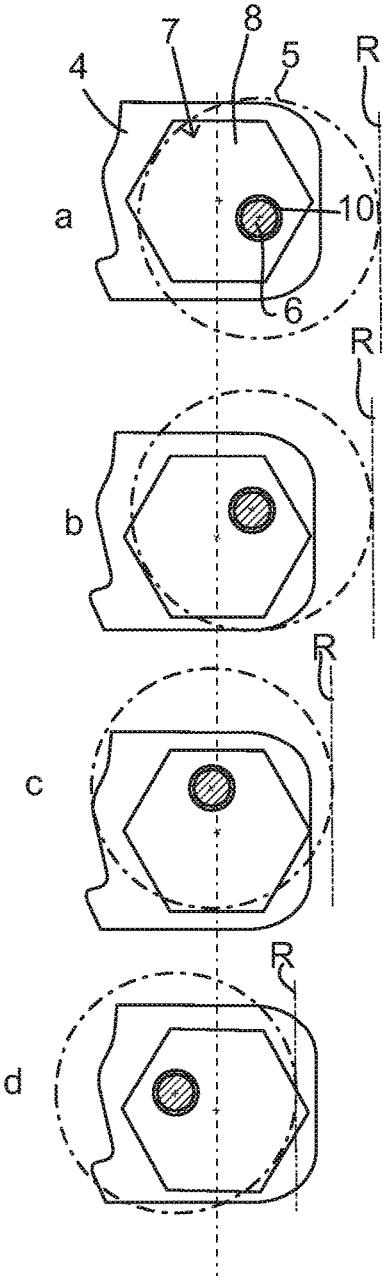

FIGS. 10, 11, 12 and 13 show four examples of the dampening elements 7 wherein the elastomer body 8 has a shape which is other than annular, i.e. polygonal. In FIG. 10 the elastomer body 8 has a square shape providing two distances for adjustment. In FIG. 11 the elastomer body 8 has a rectangular shape, also providing two distances for adjustment. In FIG. 12 the elastomer body 8 has a pentagonal shape. The pentagonal shape provides five unique distances for adjustment. In FIG. 13 the elastomer body 8 has a hexagonal shape providing four distances for adjustment. The metal tube 10 is attached to the elastomer body 8 eccentrically, i.e. the geometric center of the metal tube 10 is at a distance from the geometric center of the elastomer body 8. The position of the metal tube 10 defines the position of the shaft 6 and the shaft 6 defines the position of the outer rim of the roller wheel 5. Therefore, by rotating the vibration dampening element 7 into different angles and mounting to these angles it is possible to adjust the position of the roller wheel 5 in relation to the shaft support member 4 for adaptation of the roller guide assembly to different guide rail sizes. As shown in FIGS. 10-13, the square, rectangular, pentagonal and hexagonal shapes enable stepped adjustment.

Figure 14:
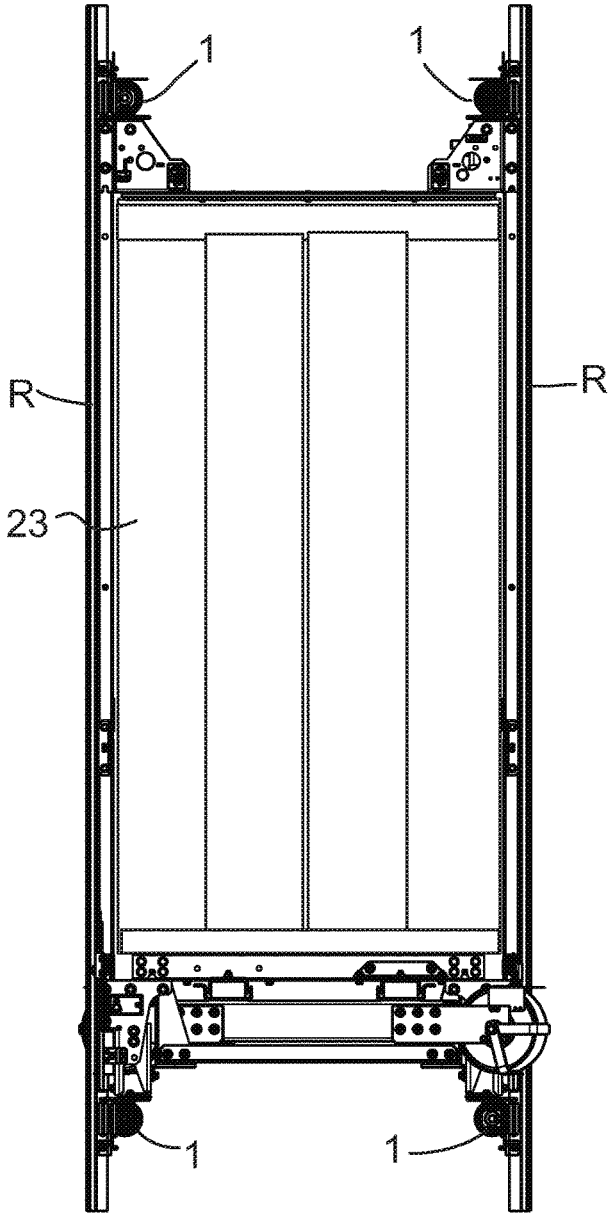
FIG. 14 shows an elevator system wherein four roller guide assemblies according to the invention are installed to the sling of the elevator car.
Figure 15:
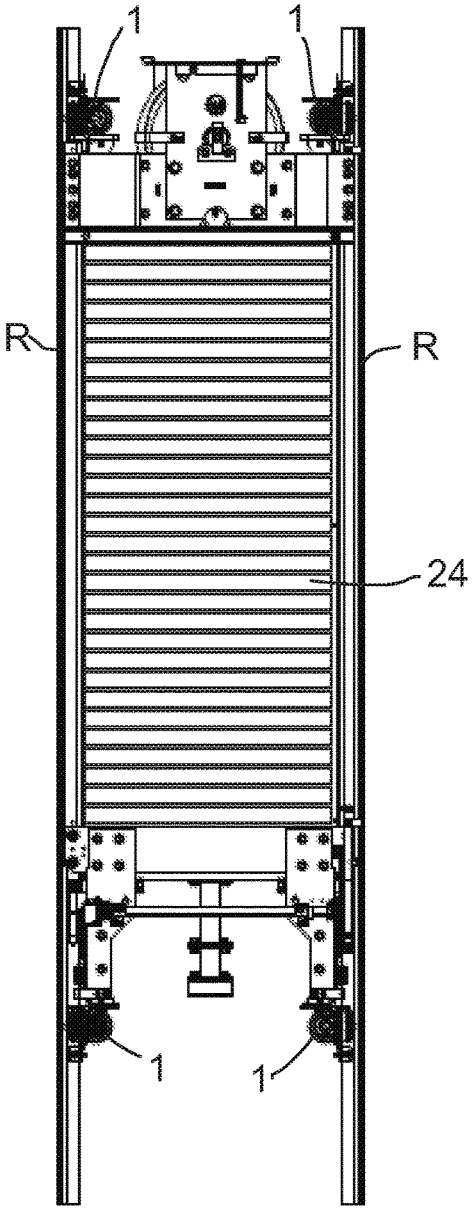
FIG. 15 shows an elevator system wherein four roller guide assemblies according to the invention are installed to the counterweight.

FIGS. 14 and 15 illustrate an elevator system comprising a car 23 (FIG. 14) and a counterweight 24 (FIG. 15). The system comprises a four roller guide assemblies 1 as described above mounted to the car 23 and to the counterweight 24.

Although the invention has been the described in conjunction with certain types of roller guide assemblies, it should be understood that the invention is not limited to any certain type of roller guide assembly. While the present inventions have been described in connection with a number of exemplary embodiments, and implementations, the present inventions are not so limited, but rather cover various modifications, and equivalent arrangements, which fall within the purview of prospective claims.

The invention claimed is:

1. A roller guide assembly for an elevator device, the roller guide assembly comprising:

a base member having a mounting means for mounting to the elevator device, the base member including a shaft support member;

at least one roller wheel configured to engage a guide rail to be rolled on the guide rail;

a shaft on which the at least one roller wheel is bearing-mounted, the shaft being straight and non-rotatably supported by the shaft support member; and a vibration dampening element including a metal tube and an elastomer body, the metal tube having a first central through hole through which the shaft extends, and the elastomer body being attached to an outer surface of the metal tube such that the elastomer body is between the shaft and the shaft support member for dampening vibration of the at least one roller wheel and for isolating the vibration from the base member, when in use, the vibration dampening element configured to attach the shaft to the shaft support member such that a juncture of the vibration dampening element and the shaft forms a sole attachment point of the shaft to the shaft support member and the sole attachment point allowing the elastomer body of the vibration dampening element to form an elastically spring-loaded universal joint to provide a universal degree of freedom to angularly tilt the shaft and the at least one roller wheel in relation to the base member while the shaft remains non-rotatably supported by the shaft support member.

2. The roller guide assembly according to claim 1, wherein the base member and the shaft support member are formed of a single uniform metal plate, and the shaft support member is bent at a straight angle from a plane of the single uniform metal plate.

3. The roller guide assembly according to claim 1, wherein the shaft support member has a mounting hole therein such that the shaft support member is configured to receive the vibration dampening element via the mounting hole.

4. The roller guide assembly according to claim 3, wherein the elastomer body has an annular groove disposed at an outer periphery of the elastomer body, the annular groove having a width and depth adapted to receive an edge of the mounting hole such that the elastomer body is configured to mount to the shaft support member via the annular groove.

5. The roller guide assembly according to claim 4, wherein the vibration dampening element comprises:

a pair of end caps configured to cover both sides of the elastomer body, the pair of end caps each including a second central through hole through which the shaft extends, the second central through hole having a smaller diameter than an outer diameter of the metal tube, so that the pair of end caps abut against ends of the metal tube at both sides of the elastomer body.

6. The roller guide assembly according to claim 5, wherein the pair of end caps are cup-like and include an annular flange which extends over a part of the outer periphery of the elastomer body.

7. The roller guide assembly according to claim 3, wherein the vibration dampening element is divided into two vibration dampening element halves which are mounted to the mounting hole from opposite sides of the shaft support member.

8. The roller guide assembly according to claim 7, wherein each of the vibration dampening element halves comprises:

a shoulder having a diameter substantially corresponding to the diameter of the mounting hole, the shoulder of each of the vibration dampening element halves together forming an annular groove configured to receive an edge of the mounting hole such that the vibration dampening element is configured to mount to the shaft support member via the annular groove.

9. The roller guide assembly according to claim 1, wherein the elastomer body is annular or polygonal, such as square, rectangular, pentagonal or hexagonal in shape.

10. The roller guide assembly according to claim 1, wherein the elastomer body is concentrically or eccentrically around the metal tube fixedly attached to the outer surface.

11. The roller guide assembly according to claim 10, wherein the outer surface of the metal tube is cylindrical.

12. The roller guide assembly according to claim 10, wherein the outer surface of the metal tube comprises:

a conical portion.

13. The roller guide assembly according to claim 1, wherein the vibration dampening element comprises:

a mounting flange made of metal, the mounting flange being fixedly attached to the elastomer body, the mounting flange having bolt holes for attaching the vibration dampening element to the shaft support member via bolted joints.

14. The roller guide assembly according to claim 1, wherein the at least one roller wheel comprises:

two or more roller wheels.

15. The roller guide assembly according to claim 1, wherein the vibration dampening element comprises:

a pair of end caps configured to cover both sides of the elastomer body.

16. The roller guide assembly according to claim 15, wherein:

the pair of end caps each include a second central through hole through which the shaft extends, the second central through hole having a smaller diameter than an outer diameter of the metal tube, so that the pair of end caps abut against ends of the metal tube at both sides of the elastomer body.

17. An elevator system, comprising:

one or more of a car and a counterweight; and the roller guide assembly according to claim 1 mounted to the one or more of the car and the counterweight.

18. A roller guide assembly for an elevator device, the roller guide assembly comprising:

a base member having a mounting means for mounting to the elevator device, the base member including a shaft support member;

at least one roller wheel configured to engage a guide rail to be rolled on the guide rail;

a shaft on which the at least one roller wheel is bearing-mounted, the shaft being straight and non-rotatably supported by the shaft support member; and a vibration dampening element including an elastomer body arranged between the shaft and the shaft support member for dampening vibration of the at least one roller wheel and for isolating the vibration from the base member, when in use, the vibration dampening element configured to attach the shaft to the shaft support member such that a juncture of the vibration dampening element and the shaft forms a sole attachment point of the shaft to the shaft support member and the sole attachment point allowing the elastomer body of the vibration dampening element to form an elastically spring-loaded universal joint to provide a universal degree of freedom to angularly tilt the shaft and the at least one roller wheel in relation to the base member while the shaft remains non-rotatably supported by the shaft support member, wherein the base member and the shaft support member are formed of a single uniform metal plate, and the shaft support member is bent at a straight angle from a plane of the single uniform metal plate.

19. A roller guide assembly for an elevator device, the roller guide assembly comprising:

a base member having a mounting means for mounting to the elevator device, the base member including a shaft support member;

at least one roller wheel configured to engage a guide rail to be rolled on the guide rail;

a shaft on which the at least one roller wheel is bearing-mounted, the shaft being straight and non-rotatably supported by the shaft support member; and a vibration dampening element including an elastomer body and a pair of end caps configured to cover both sides of the elastomer body, the elastomer body arranged between the shaft and the shaft support member for dampening vibration of the at least one roller wheel and for isolating the vibration from the base member, when in use, the vibration dampening element configured to attach the shaft to the shaft support member such that a juncture of the vibration dampening element and the shaft forms a sole attachment point of the shaft to the shaft support member and the sole attachment point allowing the elastomer body of the vibration dampening element to form an elastically spring-loaded universal joint to provide a universal degree of freedom to angularly tilt the shaft and the at least one roller wheel in relation to the base member while the shaft remains non-rotatably supported by the shaft support member.

* * * * *